United States Patent [19]

Yamazaki et al.

[11] Patent Number: 5,028,506

[45] Date of Patent: Jul. 2, 1991

[54] PHOTORECEPTOR FOR ELECTROGRAPHY WITH AN AMMONIUM SALT

[75] Inventors: Hiroshi Yamazaki; Takayuki Sugaiwa; Sota Kawakami; Masataka Takimoto; Koyoshi Sawada, all of Hino, Japan

[73] Assignee: Konica Corporation, Tokyo, Japan

[21] Appl. No.: 462,843

[22] Filed: Dec. 27, 1989

Related U.S. Application Data

[63] Continuation of Ser. No. 180,600, Apr. 6, 1988, abandoned, which is a continuation of Ser. No. 888,461, Jul. 21, 1986, abandoned.

[30] Foreign Application Priority Data

| | | | |
|---|---|---|---|
| Jul. 23, 1985 | [JP] | Japan | 60-162529 |
| Aug. 29, 1985 | [JP] | Japan | 60-190478 |
| Sep. 6, 1985 | [JP] | Japan | 60-198371 |
| Sep. 11, 1985 | [JP] | Japan | 60-201426 |

[51] Int. Cl.[5] ..... G03G 5/09

[52] U.S. Cl. ..... 430/58; 430/83; 430/95

[58] Field of Search ..... 430/83, 90, 58, 95

[56] References Cited

U.S. PATENT DOCUMENTS

| | | | |
|---|---|---|---|
| 3,250,613 | 5/1966 | Gramza et al. | 430/90 |
| 3,705,913 | 12/1972 | Fox et al. | 260/391 |
| 3,798,032 | 3/1974 | Miller | 430/67 |
| 3,907,738 | 9/1975 | Markhart et al. | 260/29.6 |
| 3,951,654 | 4/1976 | Mammino | 430/66 |
| 4,579,801 | 4/1986 | Yashiki | 430/60 |

FOREIGN PATENT DOCUMENTS

| | | |
|---|---|---|
| 0068433 | 5/1983 | European Pat. Off. . |
| 106963 | 5/1984 | European Pat. Off. . |
| 1497115 | 5/1979 | Fed. Rep. of Germany . |
| 2828575 | 7/1979 | Fed. Rep. of Germany . |
| 1377510 | 8/1963 | France . |
| 1106802A | 4/1983 | United Kingdom . |

OTHER PUBLICATIONS

Patent Abstracts of Japan, unexamined applications, P field, vol. 8, No. 1, 1/6/84, p. 76 P246, JPA 58-166,351.

Patent Abstracts of Japan, unexamined applications, P field, vol. 8, No. 1, 1/6/84, p. 77 P246, JPA 58-166,352

*Primary Examiner*—John Goodrow

*Attorney, Agent, or Firm*—Jordan B. Bierman

[57] ABSTRACT

A photoreceptor for electrophotography having a layer containing a charge generating substance on an electrically conductive substrate wherein the photoreceptor has a low molecular weight ammonium salt in a proportion of 0.1 to 15 parts by weight with respect to 100 parts by weight of the charge generating substance.

24 Claims, 1 Drawing Sheet

PHOTORECEPTOR FOR ELECTROGRAPHY WITH AN AMMONIUM SALT

This application is a continuation of application Ser. No. 180,600, filed Apr. 6, 1988, now abandoned, which is a continuation of application Ser. No. 888,461, filed July 21, 1986, now abandoned.

FIELD OF THE INVENTION

This invention relates to an electrographic photoreceptor, and more particularly to an electrographic photoreceptor which can improve repetition characteristics without degrading sensitivity.

The present invention also relates to an electrographic photoreceptor suitable for laser exposure which can improve repetition characteristics without degrading sensitivity and capable of providing good picture images.

BACKGROUND OF THE INVENTION

Conventionally, photoconductive layers applied to electrographic photoreceptors frequently use the photoconductive materials of inorganic systems such as Se, CdS, ZnO and the like However in the case when these inorganic compounds are used as photoconductive layers of electrographic photoreceptors, they are not necessarily satisfactory from the point of view of heat resistance, durability, and toxicity. In recent years, extensive studies have been made for utilizing organic system photoconductive materials as a photosensitive layer on electrographic photoreceptors in place of the inorganic system photoconductive materials. Especially, when an organic system photoconductive material is used as a photosensitive layer of an electrographic photoreceptor, the electrographic photoreceptor becomes flexible, and easy to produce, and it allows a cheaper electrographic photoreceptor.

However, it is the present status of the art, that a photoreceptor which can satisfy the variety of characteristics required for an electrographic photoreceptor, such as sensitivity, durability or the like at a time, has not yet been found.

First, as the technology which can improve the durability of the electrography photoreceptor using the organic system photoconductive substances are known a number of technologies.

There is, for example, disclosed in the Japanese Patent Publication Laid-Open No. 157/84, a technology which improves the repetition characteristics by adding N, N-disubstituted dithiocarbamate in the photosensitive layer. This technology has a certain degree of effect on the $O_3$ degradation, but has a conservancy disadvantage under high temperature and high humidity which lowers the sensitivity.

Further, in Japanese Patent Laid-Open No. 218447/84, there is disclosed a technology in which the repetition stability of electric potential is improved by adding amine to the composition of a photosensitive layer. However, this technology has the disadvantage of lowering sensitivity.

Further still, in Japanese Patent Publication Laid-Open No. 166351/83 and No. 166352/83, there are disclosed technologies in which a polymer of a specified quarternary ammonium salt is used as a binder resin for charge-generating substances. However, this technology requires to control reactivity, compositions or the like, so that it has the disadvantages of lacking production stability, having large fluctuation of characteristics and the lowering sensitivity.

Also, in recent years, laser beam printers which utilize the electrophotographic process and form images by using laser light as an optical source have been developed. Gas lasers of He-Ne, Ar, etc., or semiconductor lasers as the laser light source. As the photoreceptor for these laser beam printers, an electrographic photoreceptor for usual light source can be utilized, when the wavelength of the laser light source agrees to the spectral sensitivity range of the receptor.

But, since the laser light potentially causes interference, a new problem has occurred; that is, since the laser light interferes with the conductive base body on the surface of the photoreceptor, there is produced a pattern known as "moire" in the printed picture image, and the quality of the picture degrades significantly. The phenomenon of moire becomes an especially significant fault in the case when a semiconductor laser is used as a light source.

The moire pattern is the result of the interference of the repetitive reflection light at the air-photosensitive layer interface and the Al-layer surface, and it is considered that when the refelected light from the air-photosensitive layer interface and the reflected light from the Al interface have the same degree of strength, the interference fringes show maximum contrast, and in a half tone picture image, a so-called grain pattern is observed.

SUMMARY OF THE INVENTION

Therefore, it is the primary object of the present invention to provide an electrographic photoreceptor which is improved in repetitive characteristics without lowering sensitivity, and moreover, has an excellent preservation stability.

Further, another object of the present invention is to provide a practically useful electrographic photoreceptor for laser-exposure use, which is stabilized in repetitive characteristics without lowering sensitivity, and satisfies the characteristics required for the electrographic photoreceptor for the laser-exposure use.

The present invention specifically relates to a photoreceptor for electrography comprising a layer containing a charge-generating substance on an electrically conductive substrate, wherein said photoreceptor comprises a low molecular ammonium salt at a proportion of 0.1 to 15 parts by weight with respect to 100 parts by weight of said charge-generating substance.

BRIEF DESCRIPTION OF THE DRAWINGS

FIG. 1 shows a layer construction of the photoreceptor in accordance with the present invention which has a charge-transporting layer 3, a charge-generating layer 2, and a conductive substrate 1 in this order from the upper layer.

FIG. 2 shows an another layer construction in which a subbing layer 4 (a layer having the function of an intermediate layer, adhesive layer, and the like) is disposed (interposed) between the charge-generating layer 2 and the conductive substrate 1.

FIG. 3 shows a still another layer construction of the photoreceptor which has a charge-generating layer 2, a charge-transporting layer 3, and a conductive substrate 1 in this order from the upper layer.

FIG. 4 shows a similar layer construction as shown in FIG. 3, except that a subbing layer 4 (a layer having the function of an intermediate layer, an adhesive layer, and the like) is disposed between a charge-transporting layer 3 and a conductive substrate 1.

FIG. 5 shows a still another layer construction of the photoreceptor which comprises a charge-generating layer 2A containing a charge-generating substance and a charge-transportating substance, a charge-transporting layer 3, and a conductive substrate 1.

FIG. 6 shows a similar layer construction as shown in FIG. 5 with an exception that a subbing layer 4 (a layer having the function of an intermediate layer, an adhesive layer, etc.) is disposed between the charge-transporting layer 3 and a conductive substrate 1.

FIG. 7 shows a still another layer construction of the photoreceptor of the invention which comprises a charge-generating layer 2, in which a charge-generating substance or a charge-generating substance and a charge-transporting substance are uniformly dispersed or dissolved on a conductive substrate 1.

FIG. 8 shows a similar layer construction as shown in FIG. 7 with the exception that a subbing layer 4 is provided between the charge-generating layer 2 and the conductive substrate 1.

PREFERRED EMBODIMENT OF THE INVENTION

Figure 1:
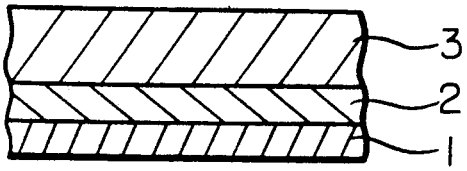
FIGS. 1 through 8 show examples of the cross sectional views of the construction of preferred layers of the electrographic photoreceptors according to the present invention.

The compounds according to the present invention preferably have a molecular weight of less than 2000, or more preferably less than 1000, and most preferably, less than 750. When the molecular weight exceeds 2000, the compatibility for the binder lowers, and deposition or the like are likely to occur, which may have disadvantageous effect upon the humidity resistance or the like.

As the low molecular salt preferably used in the present invention, following class of compounds (a) and (b) can be mentioned:

(a) Compounds represented by the general formula (I) given below, and (b) Quadrivalent nitrogen-containing heterocyclic compounds salt, preferably those represented by the general formulae (II) and (III), which are hereinafter explained in detail.

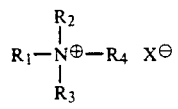

(I)

(wherein, $R_1$ is selected from the group consisting of a non-cyclic hydrocarbon group which may be substituted and a cyclic hydrocarbon group which may be substituted; $R_2$, $R_3$ and $R_4$ are independently selected from the group consisting of a hydrogen atom, a non-cyclic hydrocarbon group which may be substituted and a cyclic hydrocarbon group which may be substituted; and $X^{\ominus}$ is an anion.)

As a non-cyclic hydrocarbon group which may have a substituent, can be cited a saturated or unsaturated non-cyclic hydrocarbon group, and as a saturated non-cyclic hydrocarbon group can be cited an alkyl group (especially, alkyl group with carbon number of 1 to 20) and as an unsaturated non-cycle hydrocarbon group, an alkenyl group can be cited (especially, alkenyl group with carbon number 2 to 20), alkinyl group, and alkadienyl group. Among these ones, alkyl group (especially, alkyl group of carbon number 1 to 20) and alkenyl group (especially, alkenyl group of carbon number 2 to 20) are preferable, and particularly, alkyl group (in which, alkyl group of carbon number 1 to 20) is most preferable.

As the alkyl group as a saturated non-cyclic hydrocarbon group can be cited, for example, methyl group, ethyl group, n-propyl group, iso-propyl group, n-butyl group, iso-butyl group, tertiary butyl group, n-pentyl group, n-hexyl group, n-heptyl group, n-octyl group, 2-thylhexyl group, dodecyl group, hexadecyl group, octadecyl group and the like.

As the alkenyl groups of unsaturated non-cyclic hydrocarbon groups, there are, for example, vinyl group, allyl group, 3-methyl-2-butenyl group, isopropenyl group, 2-butynil group, etc., and as examples of alkinyl groups, there are ethynil group, butynil group, etc., and as examples of alkadienyl groups, 1, 3-butane dienil group, etc. can be cited.

As examples of substituents for these saturated or unsaturated non-cyclic hydrocarbon groups, can be cited halogen atoms as fluorine, chlorine, bromine; cyano groups; hydroxyl groups; acyl groups; alkoxy groups such as methoxy groups, ethoxy groups, etc.; aryl groups such as phenyl groups, etc.; and aryl-oxy groups such as phenoxy groups, etc.

As alkyl groups having a substituent, there are, for example, benzyl group, phenethyl group, trithyl group, diphenyl-methyl group, hydroxyethyl group, methoxyethyl group, cyanoethyl group, acethoxyethyl group, acetylethyl group, chloromethyl group, etc., and as alkenyl group having aforementioned substituent, there are, for example, styril group, cinnamyl group, etc.

As cyclic hydrocarbon groups which may have a substituent, there are mono-cyclic hydrocarbon groups (for example, mono-cyclic hydrocarbon groups with carbon number 3 to 12), bridged hydrocarbon groups (for example, bridged hydrocarbon groups with carbon number 6 to 18) and condensed multi-ring hydrocarbon groups (for example, condensed multi-ring hydrocarbon groups with carbon number 7 to 18).

As examples of mono-cyclic hydrocarbon groups can be cited cycloalkyl groups, aromatic groups with mono-cyclic, etc. As examples of cycloalkyl groups, can be cited cyclopentyl group, cyclohexyl group, etc., and as a mono-cyclic aromatic group, can be cited phenyl group, and the other ones such as cyclododecatrienyl groups, etc. can be cited. As examples of bridged hydrocarbon groups, there are dicylopentadienyl group, norbornyl group, adamantyl group, etc. As examples of condensed multi-ring hydrocarbon groups, there are naphtyl group, anthryl group, phenanthyl group, indenyl group, etc.

As examples for these substituents of cyclic hydrocarbon groups can be cited halogen atoms such as fluorine, chlorine, bromine, etc.; alkyl groups such as methyl, ethyl, etc.; cyano group; acyl group; nitro group; hydroxy group; alchoxy groups such as methoxy group, ethoxy group, etc.; and aryloxy groups such as phenoxy group, etc.

As mono-cyclic hydrocarbon groups having these substituent, there are, for example, tolyl group, xylyl group, cumenyl group, methoxyphenyl group, mesityl group, etc, As examples of anions represented by $X^{\ominus}$ can be sited negative halogen ions such as fluorine, chlorine, bromine, iodine; inorganic acid anions such as tetrafluoroboron ion, hexafluorophosphor ion, carbonic acid ion, sulfuric acid ion, phosphoric acid ion, nitric acid ion, perchloric acid ion, etc.; other inorganic anions such as hydroxy ions, etc.; carbonic acid ions such as acetic acid ion, oxalic acid ion, propionic acid ion, benzoic acid ion, etc.; sulphonic acid ions of such as benzene sulphonic acid; and alchoxy irons such as methoxy iron, ethoxy ion, etc. Above all, halogen ions and the inorganic acid anions are preferable.

(b) Quadrivalent nitrogen-containing heterocyclic compound salt

The quadrivalent nitrogen-containing compound is produced by ionizing the trivalent nitrogen of a heterocyclic compound containing trivalent nitrogen, and may contain, other than nitrogen, sulfur, oxygen, selenium, phosphorus, arsenic, silicon, germanium, boron, etc.

As representative example of said quadrivalent nitrogen-containing cyclic compound, those represented by the following general formula (II) or (III) can be mentioned:

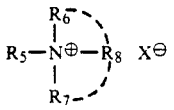
(II)

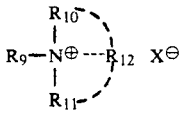
(III)

(wherein, $R_5$, $R_6$ and $R_9$ are independently selected from the group consisting of a hydrogen atom, a noncyclic hydrocarbon group which may be substituted and a cyclic hydrocarbon group which may be substituted; $R_7$ and $R_8$ are independently groups necessary to complete a substituted or unsubstituted nitrogen-containing heterocyclic group including the quadrivalent nitrogen by being cooperatively connected with each other; $R_{10}$, $R_{11}$ and $R_{12}$ are independently groups to complete a substituted or unsubstituted nitrogen-containing heterocyclic group including the quadrivalent nitrogen being cooperatively connected with each other; and $X^-$ is an anion.)

As a representative examples of the mother nucleus of said quadrivalent nitrogen-containing heterocyclic ring compound salts can be cited the following ones shown by the formulae (A) to (K). Into these mother nucleus may be introduced substitution groups if required.

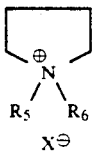
(A)

-continued

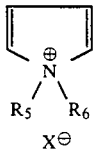
(B)

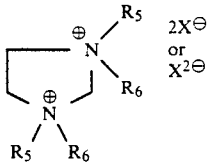
(C)

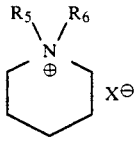
(D)

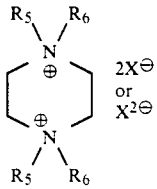
(E)

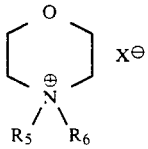
(F)

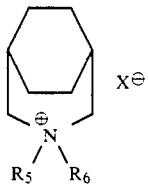
(G)

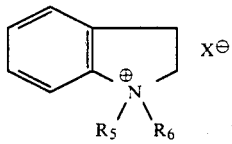
(H)

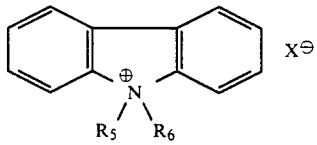
(I)

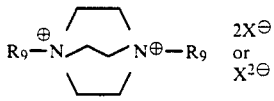
(J)

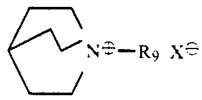
(K)

In the above formulae (C), (E), and (J), $X^{\ominus}$ denotes a monovalent anion and $X^{2\ominus}$ denotes a divalent anion, respectively, and "$2X^{\ominus}$ or $X^{2\ominus}$" means that either one of $2X^{\ominus}$ or $X^{2\ominus}$ will attach to the left side structural formula in the same formula.

In the above-described formula (C), two $R_5$ groups combined with different nitrogen atoms may be identical or different. Furthermore, the same notice can be given to the group $R_6$ and also to (E). Further, $R_9$ combined with different nitrogen atoms in (J) may be the same one or a different one. Furthermore, in each of (A) to (K), respectively, as examples of substituents introduced into the mother nucleus can be cited the same ones as described in the above-described general formula 1.

Among the low molecular weight ammonium salts those represented by the formula $$N^{\oplus}(H)_l(C_nH_{2n+1})_m X^{\ominus}$$

(wherein l is an integer of 0 to 3, m is an integer of 1 to 4 provided that l+m is 4, n is an integer of 1 to 20, and X is an anion) are particularly advantageous in the present invention, and more particularly, when l is 2, m is 2, n is an integer of 1 to 8, and X is a halogen atom.

In the following, further-description will be made on the present invention.

Figure 5:
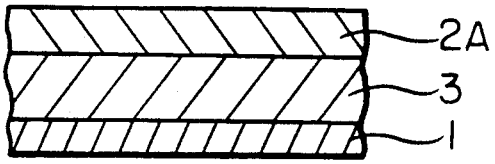
Figure 2:
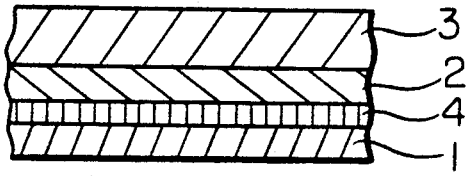
Figure 6:
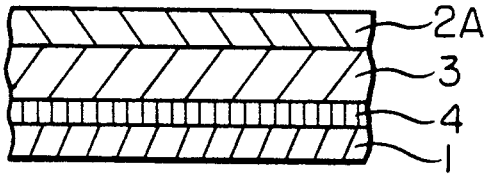
Figure 3:
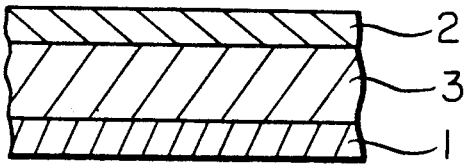
Figure 7:
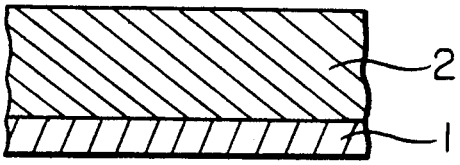
Figure 4:
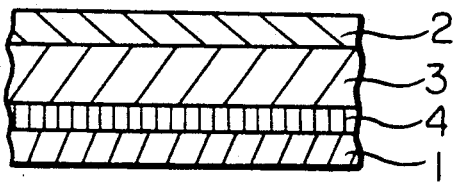
Figure 8:
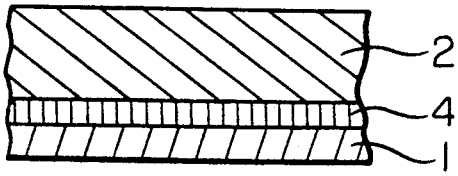

The electrographic photoreceptor of the present invention is provided, as shown in FIGS. 1 to 8, with a charge-generating layer 2 containing charge-generating substance on a conductive substrate 1, but the charge-generating layer containing said charge-generating substance may also contain charge-transporting substance. (Hereinafter, this layer is also referred to as a charge-generating layer.) Also, it may be the one in which the charge-generating layer containing the charge-generating substance and the charge-transporting layer containing the charge-transporting substance are laminated.

Among the layer constructions, those shown in FIGS. 2, 4, 6 and 8 are preferable.

In the above-described layer construction, an intermediate layer may be provided between respective layers and a surface protecting layer may also be formed on the uppermost layer.

As the conductive substrate, those molded of a metal such as aluminium, brass, stainless steel, etc. in drum-like form or made into a sheet form or a foil, are used. Also, insulating materials of the high polymers such as polyethylene terephthalate, nylon, polyarylate, polyimide, polycarbonate, etc., hardened paper and the like are used by molding in drum-like form or by making them in form of a sheet after they are treated to acquire conductivity. As the methods of conductive treatment, there are such ones as the immersion in a conductive substance, lamination of a metal foil (for example, aluminium foil), vapor deposition of a metal (for example, aluminium, indium, tin oxide, yttrium, etc.), conductive finishing method, and the like.

In the present invention, those which have high reflectivity of the surface can acquire larger effect of invention. As more preferable conductive substrates can be cited films of polyethylene phthalate or the like vapor-deposited with aluminium, titanium, etc., or an aluminium drum subjected to mirror finishing.

The electrographic photoreceptor according to the present invention preferably has a subbing layer and as a material suitable for said subbing layer may be metal oxide such as aluminium oxide, indium oxide, titanium oxide, etc.; macromolecular materials such as acrylic resins, methacrylic resins, vinyl chloride resins, vinyl acetate resins, epoxy resins, urethan resins, polyester resins, phenolic resins, alkyd resins, polycarbonate resins, silicone resins, melamine resins, polyvinylformal resins, polyvinylbutyral resins, polyvinyl alcohol resins, vinyl chloride-vinyl acetate maleic acid anhydride copolymer, vinylidene chloride-acrylonitrile copolymer, styrene-butadiene copolymer, etc.; and cellulosic materials such as ethylcellulose, carboxymethyl cellulose, etc. These can be used alone or in combination of two or more kinds.

The subbing layer is formed by dissolving above-described materials in a suitable solvent, and coating on a conductive substrate to a predetermined film thickness. As the method of coating, in case when the conductive substrate is made drum-like, the immersion method, spray method, extrusion or slide hopper method or the like are preferable, and when the conductive substrate is in sheet-like form, the roll method, extrusion or slide hopper method are preferably adopted. The film thickness of a subbing layer formed in such a manner is preferably in the range of 0.01 to 10 μm, and the range of 0.05 to 5 μm is more preferable.

On the subbing layer is formed a layer containing at least a charge-generating layer. The charge-generating layer is a layer containing at least a charge-generating substance, exclusively with said substance or by dispersing in a binder, and is preferably formed on the conductive substrate by coating.

As the charge-generating substance, guaiazulene pigments (for example, Japanese Patent Publication Laid-Open No. 53850/84), perylene pigments (for example, ibid. No. 24852/84 and No. 30330/72) phthalocyanine pigments (for example, ibid. No. 9536/78 and No. 9537/84).

Pyrylium pigments (for example, ibid. No. 40531/78) quinacridone pigments (for example, ibid. No. 30332/72) indigo pigments (for example, ibid. No. 30331/72), cyanine pigments (for example, ibid. No. 21343/79), azo pigments (for example, ibid. No. 194035/83; ibid. No. 115447/83; ibid. No. 723757/84; ibid. 72376/84; ibid. 73820/84). Among them, azo pigments, especially, bis-azo pigments, tris-azo and phthalocyanine pigments are preferably used, as their wavelength ranges are suitable to the laser light exposure.

As azo pigments, can be cited concretely the following compounds:

(G-1)
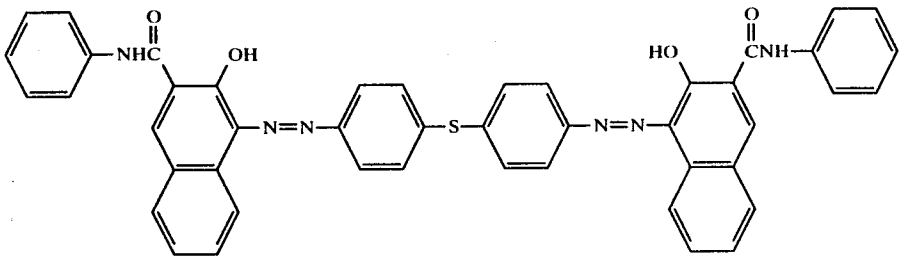
(G-2)
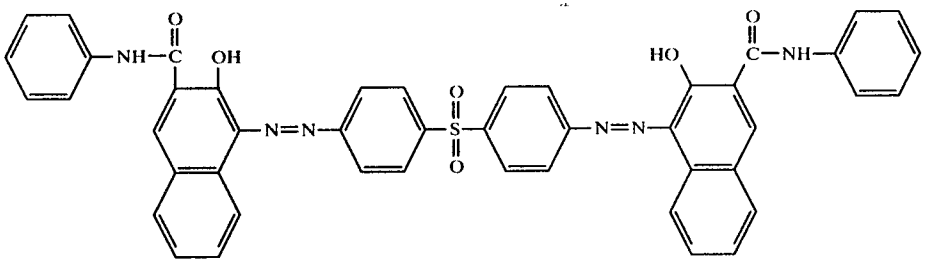
(G-3)
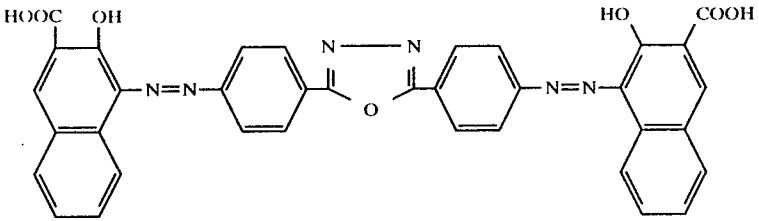
(G-4)
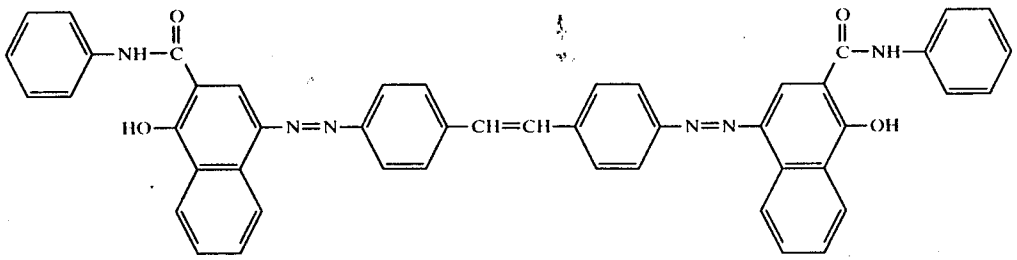

-continued
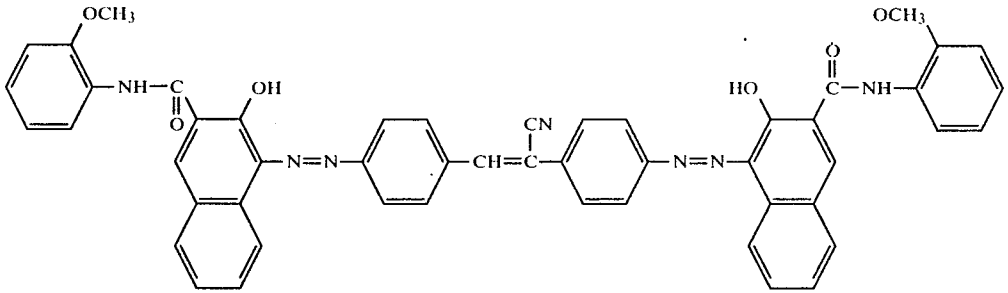
(G-5)
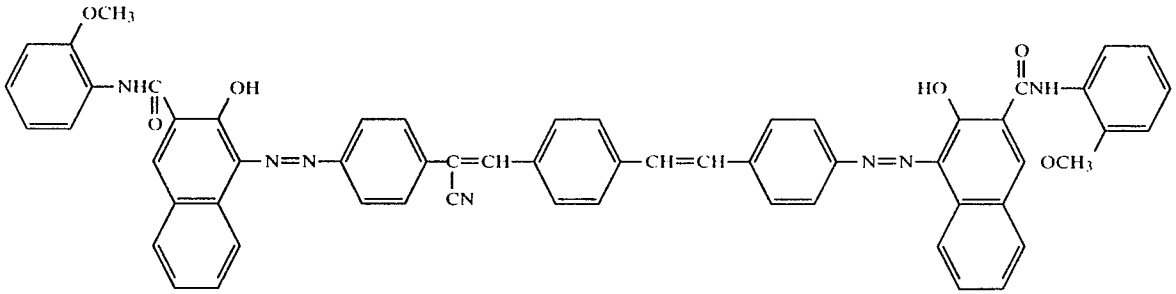
(G-6)
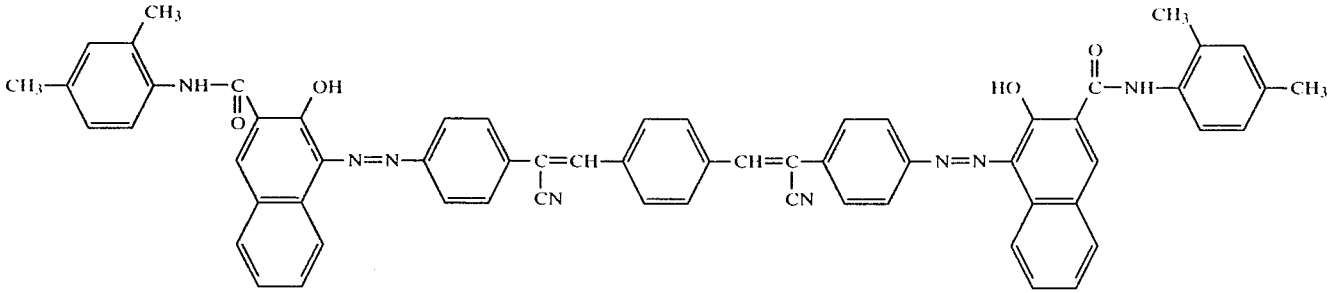
(G-7)

-continued
(G-8)
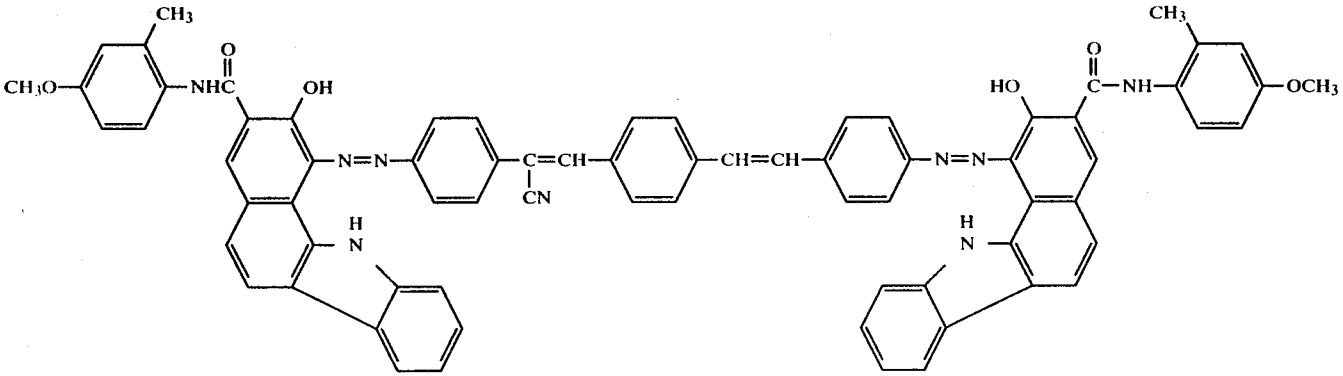
(G-9)
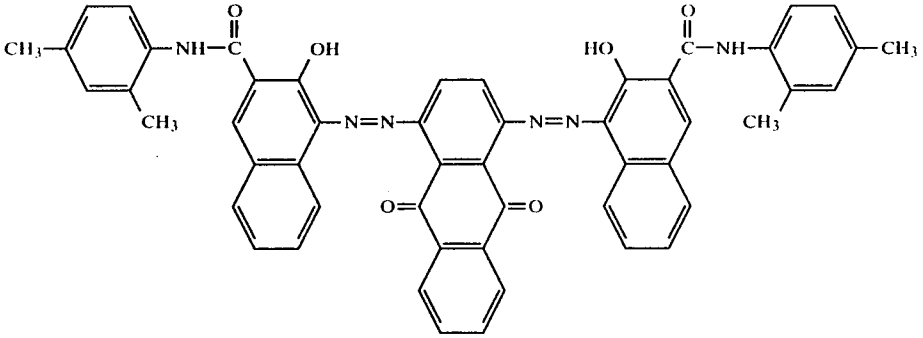
(G-10)
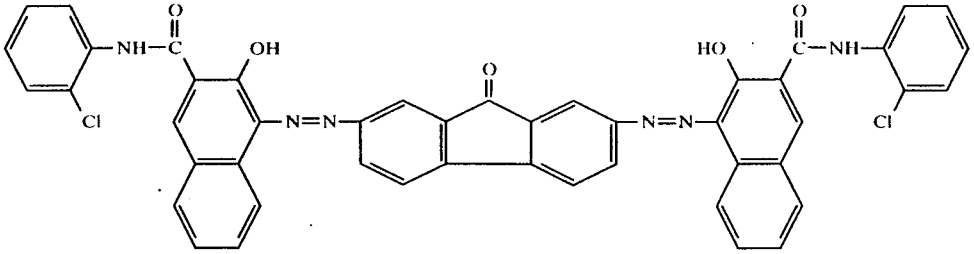

-continued
(G-11)
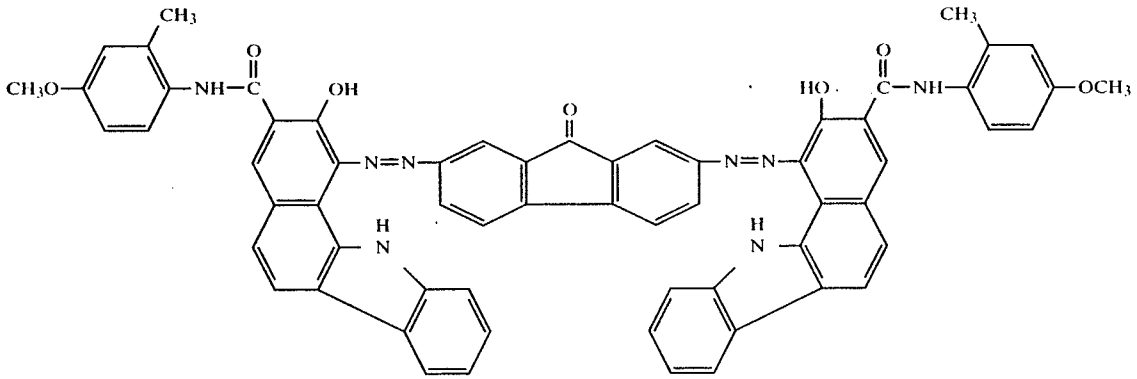
(G-12)
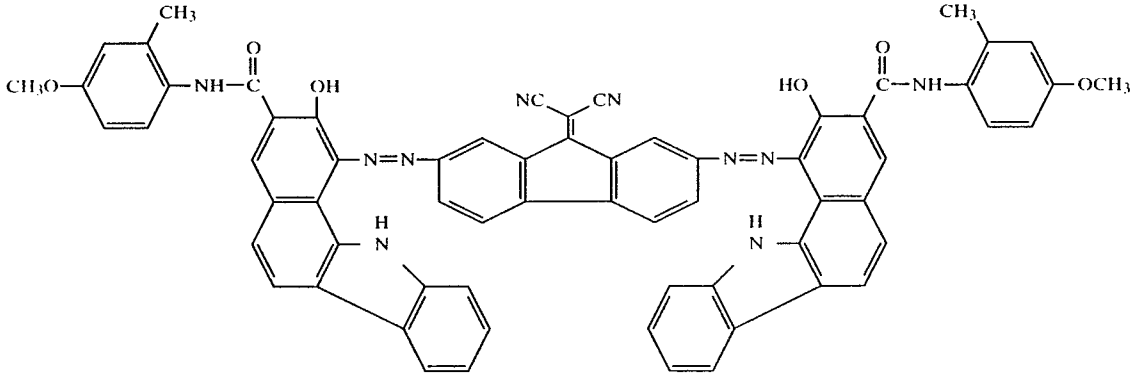
(G-13)
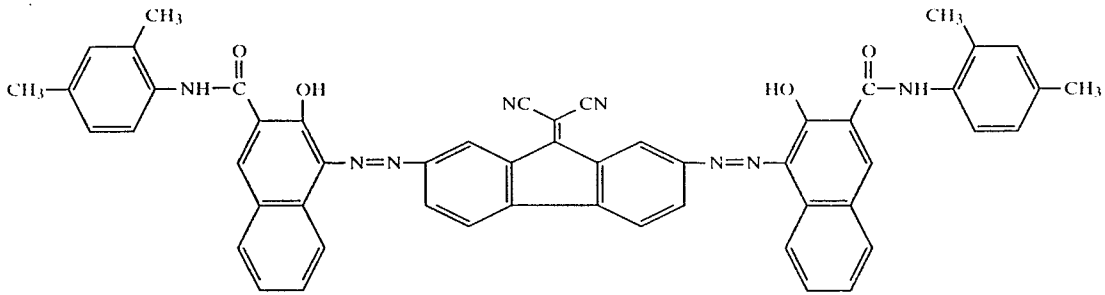

-continued
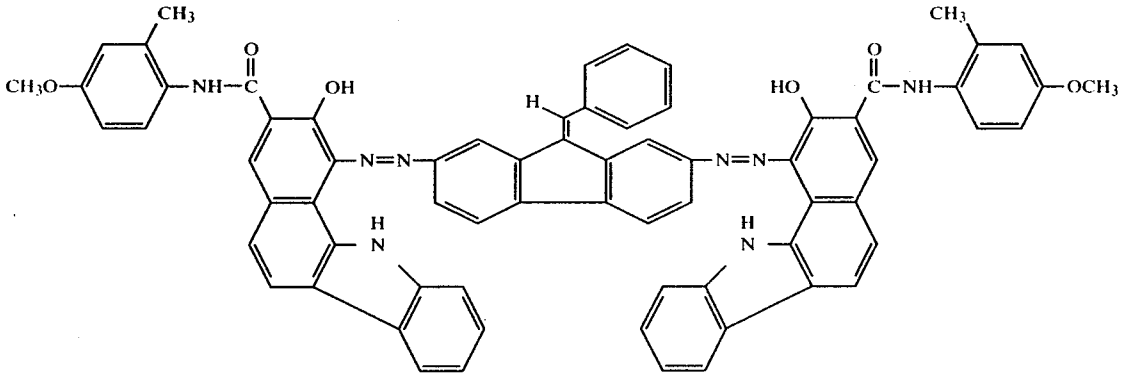
(G-14)
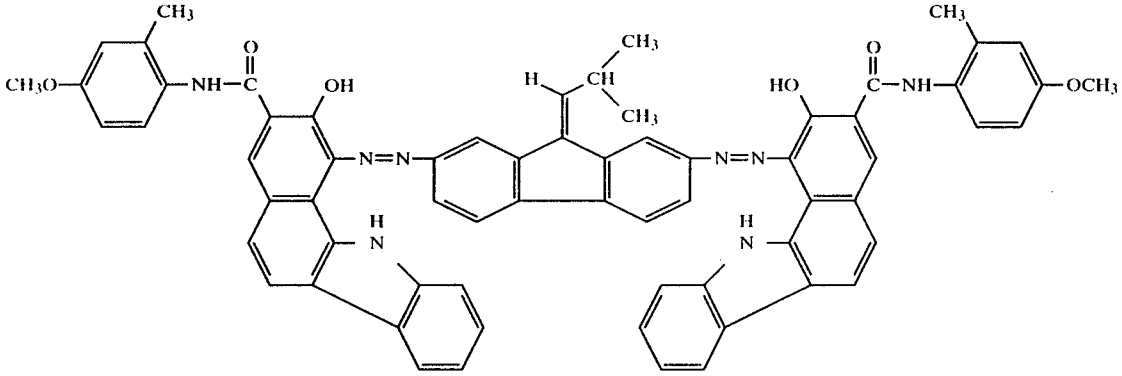
(G-15)
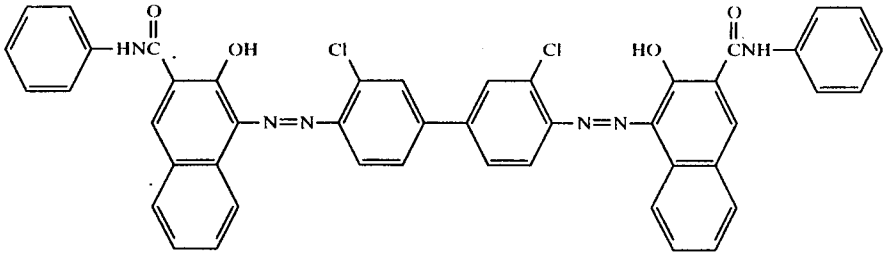
(G-16)

-continued
(G-17)
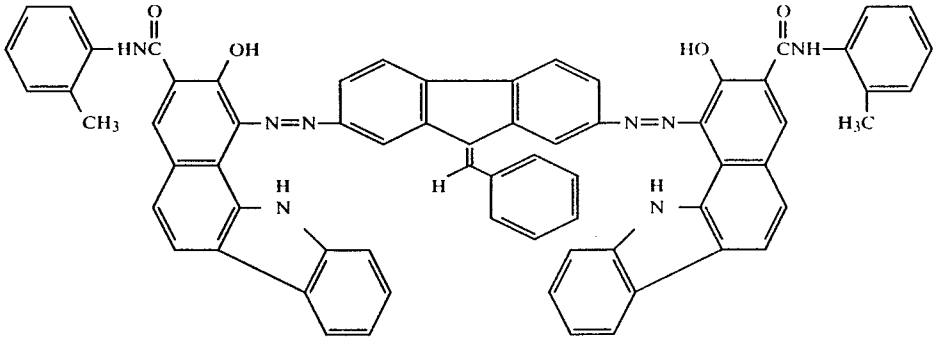
(G-18)
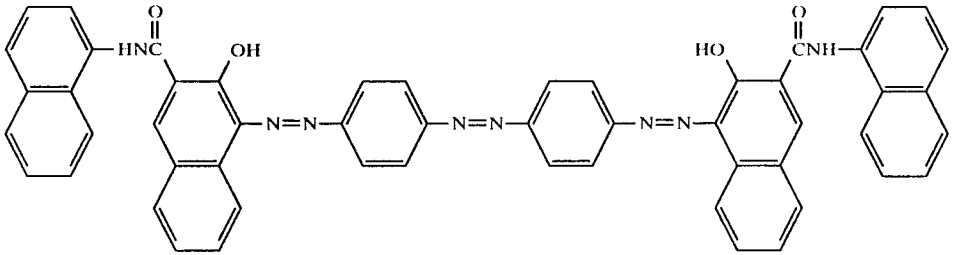
(G-19)
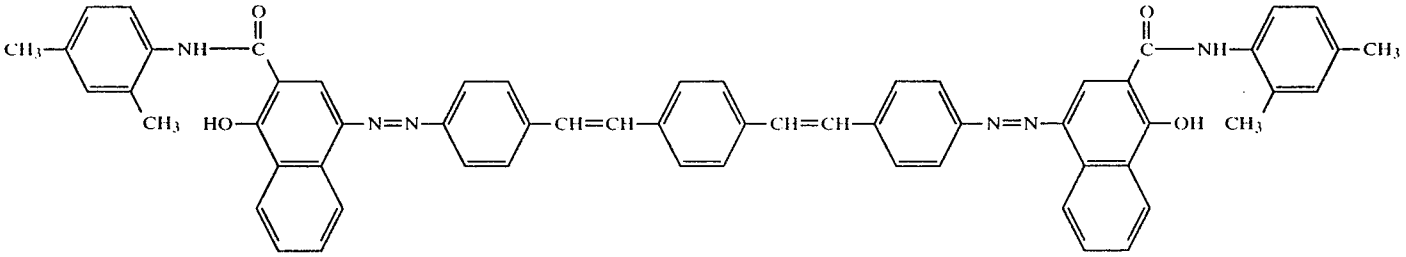

Other than the above-described ones, as preferable examples of azo pigments can be cited the tris-azo pigments disclosed in Japanese Patent Publication Laid-Open No. 132347/78.

As means for dispersing a charge-generating substance can be used dispersing means such as a sand mill, a ball mill or an ultrasonic dispersion mean after adding the above-mentioned charge-generating substance into a suitable solvent or in a binder solution. As a binder, can be used a high-molecular material such as acrylic resins, methacrylic resins, polyester resins, polycarbonate resins, styrene resins, polyvinyl alcohol resins, polyvinylalcohol resins, polyvinylbutyral resins, etc. As a suitable solvent, can be cited 1, 2-dichloroethane, chloroform, 1,1,1-trichloroethane, dichloromethane, aceton, dioxan, methylethyl ketone, tetrahydrofuran, benzene, toluene, xylene, diethylether, etc. The mixing ratio of the charge-generating substance and the binder is for 100 parts of the charge-generating substance, the binder amounts to 0 to 500 parts, preferably 0 to 200 parts.

As representative examples of the low molecular ammonium salt compounds according to the present invention, can be cited the following compounds.

COMPOUNDS SHOWN FOR EXAMPLE $(CH_3)_2\overset{\oplus}{N}H_2Cl^{\ominus}$ (1)

$(C_2H_5)_2\overset{\oplus}{N}H_2Cl^{\ominus}$ (2)

$(n\text{-}C_3H_7)_2\overset{\oplus}{N}H_2Cl^{\ominus}$ (3)

$(n\text{-}C_8H_{17})_2\overset{\oplus}{N}H_2Cl^{\ominus}$ (4)

$(n\text{-}C_4H_9)_2\overset{\oplus}{N}H_2Cl^{\ominus}$ (5)

$(CH_3CH_2CH_2CH_2\underset{\underset{C_2H_5}{|}}{C}HCH_2)_2\overset{\oplus}{N}H_2Cl^{\ominus}$ (6)

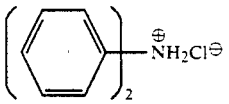
(7)

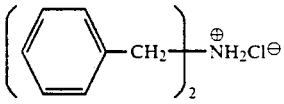
(8)

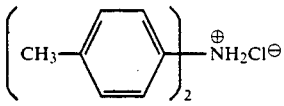
(9)

$n\text{-}C_3H_7-\overset{\oplus}{N}H_3Cl^{\ominus}$ (10)

$n\text{-}C_4H_9-\overset{\oplus}{N}H_3Cl^{\ominus}$ (11)

$n\text{-}C_8H_{17}-\overset{\oplus}{N}H_3Cl^{\ominus}$ (12)

$n\text{-}C_{14}H_{29}-\overset{\oplus}{N}H_3Cl^{\ominus}$ (13)

$n\text{-}C_{18}H_{37}-\overset{\oplus}{N}H_3Cl^{\ominus}$ (14)

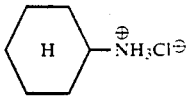
(15)

-continued $(O_2H_5)_3\overset{\oplus}{N}HCl^{\ominus}$ (16)

$(n\text{-}C_4H_9)_3\overset{\oplus}{N}HPF_6^{\ominus}$ (17)

$(n\text{-}C_8H_{17})_3\overset{\oplus}{N}HCl^{\ominus}$ (18)

$(n\text{-}C_{12}H_{25})_3\overset{\oplus}{N}HCl^{\ominus}$ (19)

$(n\text{-}C_4H_9)_2\overset{\oplus}{N}H_2BF_4^{\ominus}$ (20)

$(n\text{-}C_4H_9)_2\overset{\oplus}{N}H_2PF_6^{\ominus}$ (21)

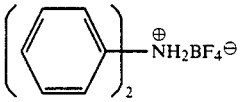
(22)

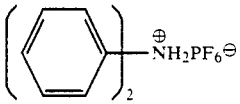
(23)

$n\text{-}C_4H_9\overset{\oplus}{N}H_3HSO_4^{\ominus}$ (24)

$n\text{-}C_4H_9\overset{\oplus}{N}H_3NO_3^{\ominus}$ (25)

$n\text{-}C_4H_9\overset{\oplus}{N}H_3O_4Cl^{\ominus}$ (26)

$n\text{-}C_4H_9\overset{\oplus}{N}H_3CH_3CH_2COO^{\ominus}$ (27)

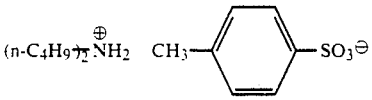
(28)

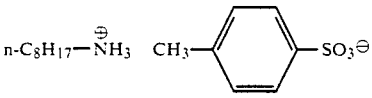
(29)

$n\text{-}C_{14}H_{29}\overset{\oplus}{N}H_3\ CH_3CH_2COO^{\ominus}$ (30)

$n\text{-}C_{14}H_{29}\overset{\oplus}{N}H_3\ n\text{-}C_{12}H_{25}COO^{\ominus}$ (31)

$n\text{-}C_{18}H_{29}\overset{\oplus}{N}H_3\ CH_3CH_2COO^{\ominus}$ (32)

$n\text{-}C_8H_{17}\overset{\oplus}{N}(CH_3)_3Cl^{\ominus}$ (33)

$n\text{-}C_8H_{17}\overset{\oplus}{N}(CH_3)_3Br^{\ominus}$ (34)

$n\text{-}C_{12}H_{25}\overset{\oplus}{N}(CH_3)_3I^{\ominus}$ (35)

$(CH_3)_4\overset{\oplus}{N}Cl^{\ominus}$ (36)

$(C_2H_5)_4\overset{\oplus}{N}ClO_4^{\ominus}$ (37)

$(C_2H_5)_4\overset{\oplus}{N}OH^{\ominus}$ (38)

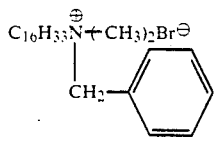
(39)

$(C_{18}H_{37})_2N(CH_3)_2Br^{\ominus}$ (40)

-continued
(41)
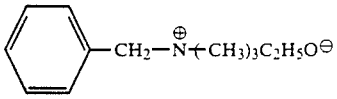
(42)
$(C_2H_5)_4N^{\oplus}C_2H_5O^{\ominus}$
(43)
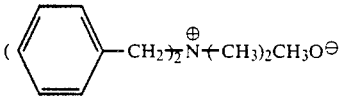
(44)
$(CH_3)_4\overset{\oplus}{N}BF_4^{\ominus}$
(45)
$(C_2H_5)_4\overset{\oplus}{N}PF_6^{\ominus}$
(46)
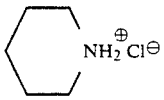
(47)
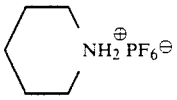
(48)
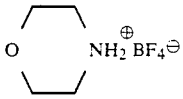
(49)
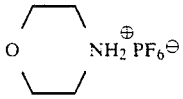
(50)
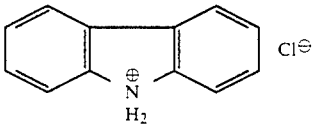
(51)
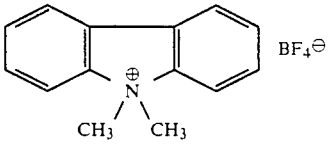
(52)
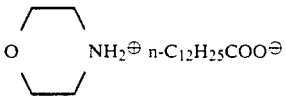
(53)
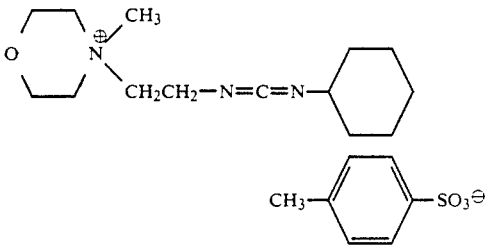
(54)
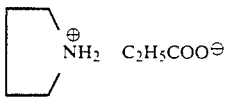
-continued
(55)
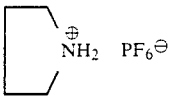
(56)
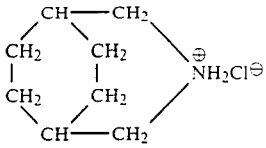
(57)
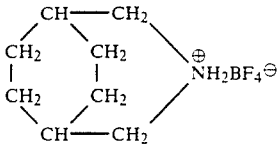
(58)
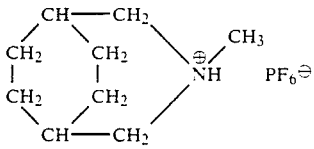
(59)
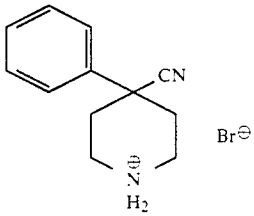
(60)
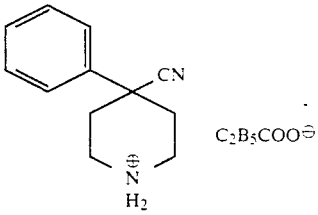
(61)
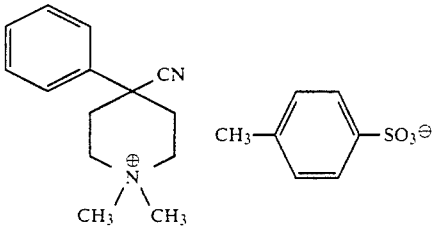
(62)
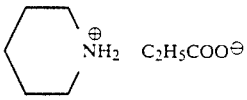
(63)
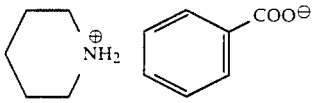
(64)
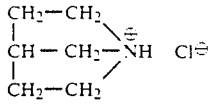

-continued

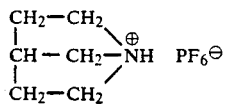

(65)

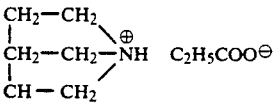

(66)

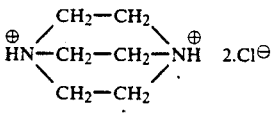

(67)

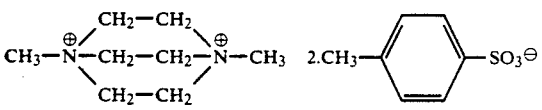

(68)

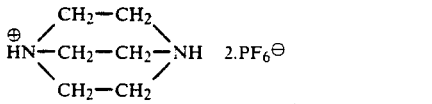

(69)

$(n\text{-}C_6H_{13})_2NH_2^{\oplus}Cl^{\ominus}$ (70)

The compounds according to the present invention can be synthesized, for example, by the methods recorded in bibliographies such as "Organic Synthesis Collective" Vol. 4 p. 84, and ibid. Vol. 4 p.98 and the like. Also, they can be obtained by general methods. As in said general methods, said compounds can be easily synthesized by adding hydrochloride gas, hydrochloric acid, sulfuric acid, nitric acid, borohydrofluoric acid, hexafluorophosphoric acid, perchloric acid, phosphoric acid, carbonic acid, a carboxylic acid such as acetic acid, etc., or a sulfonic acid such as benzosulfonic acid, etc. to a solution (such as acetone, alcohol) containing an adequate amino compound. Further, as commercially available ones, can be cited the products made by Tokyo Kasei Kogyo Co., Ltd., Kanto Kagaku Co., Ltd., and Wakoo Junyaku Kogyo Co., Ltd.

The low molecular amino compounds according to the present invention can be incorporated in anyone of the layers of the charge-generating layer and charge-transporting layer and it is particularly preferable for the compound to be incorporated in the charge-transporting layers.

The amount of addition of the compound according to the present invention is more than 0.1 part by weight or 15 parts by weight for 100 parts by weight of the charge-generating substance, and more preferably 1 to 12 parts by weight. At an amount less than 0.1 part by weight, the effect of the present invention can not be fully exerted, and when the addition amount exceeds 15 parts by weight, there occurs a problem in humidity resistance. The method of addition and use may be anyone of the method in which the charge-generating substance is added to the solvent when it is dispersed thereinto, and the method of adding and dissolving in a dispersing liquid already dispersed with the charge-generating substance.

The charge-transporting layer used in the case of constructing the photosensitive layer as a function separation type is formed by coating a solution made by dissolving a charge-transporting substance and a binder in a suitable solvent on the above-described charge-generating layer.

As a charge-transporting substance, can be cited triazole derivatives (for example, Japanese Patent Publication No. 5467/59), oxazole derivatives (for example, ibid. No. 1125/60), oxadiazole derivatives (for example, ibid. No. 5468/59), pyrazoline derivatives (for example, ibid. No. 10366/59), imidazole derivatives (for example, ibid. No. 11215/60 and ibid. No. 16096/62), fluorenon derivatives (Japanese Patent Publication Laid-Open No. 128373/77, and ibid. No. 110837/79), carbazole derivatives (for example, ibid. No. 59142/79), and further, substances described in ibid. No. 134642/83 and ibid. No. 65440/83.

Concretely, the following compounds can be cited.

As charge-transporting substances preferable in the present invention, can be cited such compounds as shown in General formula (1)

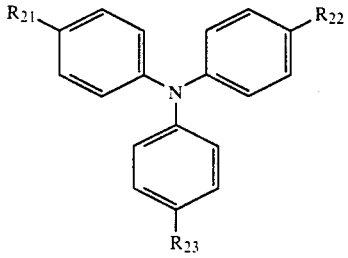

General formula (2)

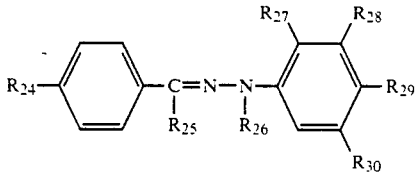

General formula (3)

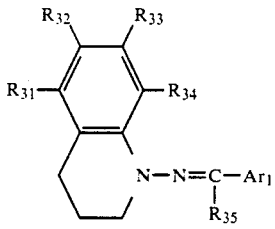

General formula (4)

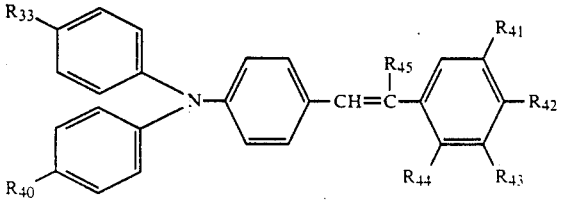

General formula (5)

-continued

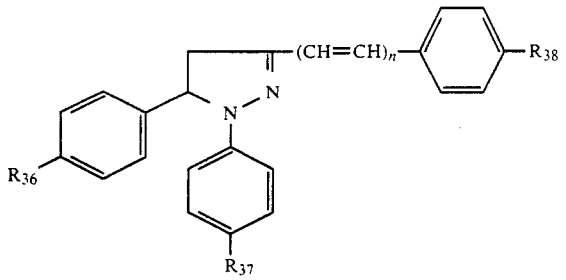

General formula (6)

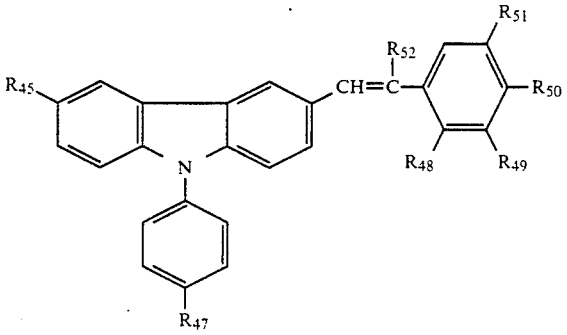

General formula (7)

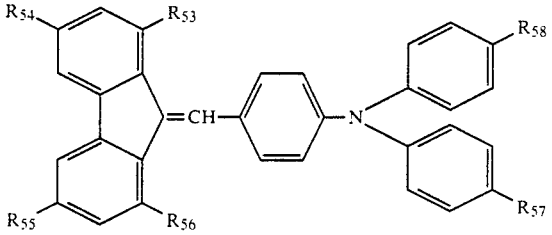

In the above formulae, $R_{21}$–$R_{24}$, $R_{27}$–$R_{34}$, $R_{36}$–$R_{44}$, $R_{46}$–$R_{51}$, $R_{53}$–$R_{58}$ independently represent a hydrogen atom, an alkyl group, an alkoxy group, a halogen atom, a hydroxy group, a cyano group, a dialkylamino group, a diarylamino group, a diaralkylamino group or a nitro group. $R_{25}$ represents an alkyl group, a phenyl group which may have a substituent, or a naphthyl group which may have a substituent, $R_{35}$ represents a hydrogen atom, an alkyl group, a cyano group, or a phenyl group which may have a substituent, $R_{35}$ represents a hydrogen atom, a phenyl group which may have a substituent, a cyano group, or an alkyl group, $Ar_1$ represents

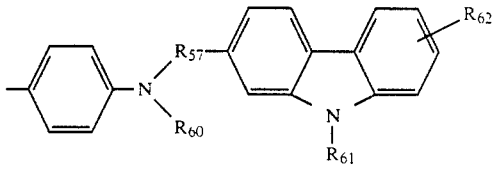

(in the formula, $R_{59}$, $R_{60}$, $R_{61}$ independently represent an alkyl group, a benzyl group, a phenyl group or a naphthyl group (each may be substituted), $R_{62}$ rerpesents a hydrogen atom, an alkyl group, an alkoxy group, a halogen atom, a hydroxy group, a diaralkylamino group, or a nitro group). $R_{45}$, $R_{52}$ represent a hydrogen atom or a phenyl group.

Concretely, the following compounds can be cited.

(a)

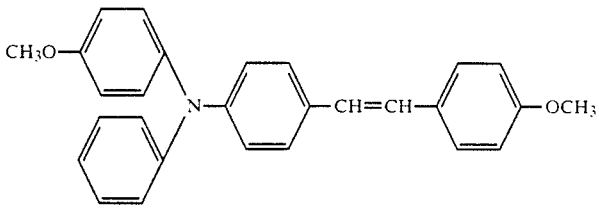

(b)

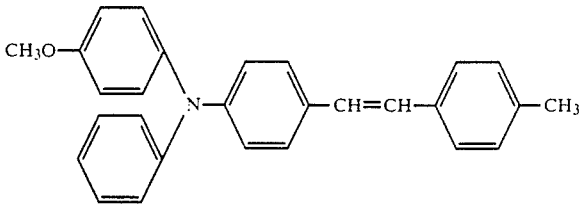

(c)

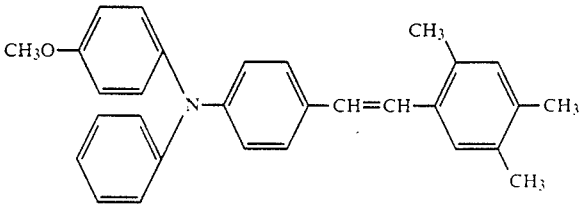

-continued (d)

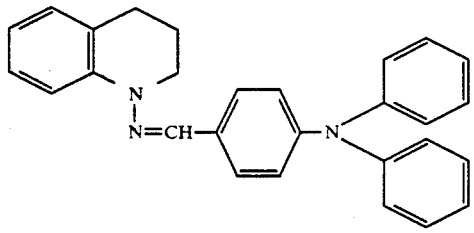

(e)

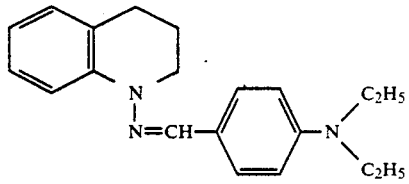

(f)

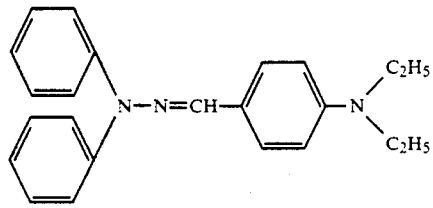

(g)

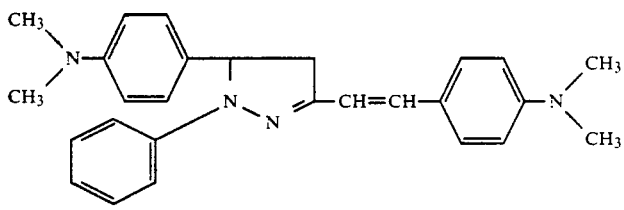

(h)

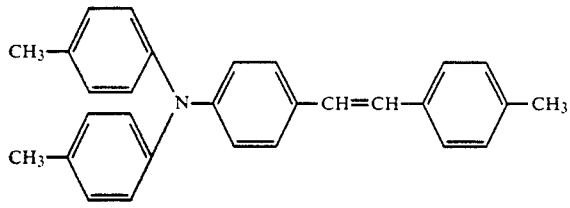

(i)

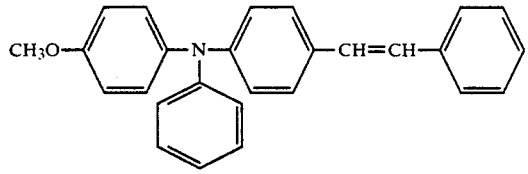

As a binder, the one which has high compatibility with the charge-transporting substance and further has high transparency and insulation properties is preferable. Those which are generally used for electrographic photoreceptors can all be used, and, for example, can be cited polyester resin, polyethylene resin, polyamide resin, polycarbonate resin, epoxy resin, polyvinylbutyral resin, polymethylmethacrylate resin, etc.

The content of the charge-transporting substance is 25 to 200 parts by weight for 100 parts by weight of the binder, and more preferably, 50 to 100 parts by weight. For the method for coating of the charge-generating layer and the charge-transporting layer can be adopted a similar method as the one for the above-described subbing layer, and the film thickness is preferable at 0.01 to 10 μm for a charge-generating layer and more preferably 0.05 to 2 μm, while 5 to 50 μm is preferable for the charge-transporting layer and more preferably 10 to 30 μm.

As a laser light source suitable for the electrographic photoreceptor for laser exposure use of the present invention can be cited a gas laser such as the He-Ne laser and Ar laser and semiconductor lasers, etc. Among other things, the use of the semiconductor laser will be expected to acquire great effect.

According to the present invention, it is possible to provide an electrographic photoreceptor having improved repetitive characteristics without lowering sensitivity and good environmental resistance with decreased fluctuation in the characteristics among plural number of photoreceptors produced even in a long elapse of time.

Furthermore, when used as an electrographic photoreceptor for laser exposure use, the moire phenomenon occurring in the while of exposure is effectively prevented and a good picture image can be obtained.

EXAMPLES

In the following, preferable Examples of the present invention will be described, but the scope of the present invention is not limited by them.

EXAMPLE 1

A dispersed liquid was obtained by grinding and dispersing 5 g of polycarbonate resin (Trade name: Panlite L-1250 made by Teijin Kasei Co.), 10 g of (G-7) as a charge-generating substance, and 1000 ml of 1,2-dichloroethane in a ball mill.

The exemplified compound (No. 2) was added in an amount of 1.0 g into the dispersed liquid obtained, and after stirring for about 1 hour, the liquid was coated on an aluminium plate by dip method, then the specimen was dried at 100° C. for 10 minutes to obtain a charge-generating layer 7 with thickness of about 0.2 μm.

Further, 150 g of polycarbonate resin (Trade name: Panlite K-1300, made by Teijin Kasei Co.) and 75 g of charge-transporting substance (a) were dissolved into 1000 ml of 1,2-dichloroethane, and the solution was coated by dip coating method on said charge-generating layer and by drying at 110° C. for 20 minutes to form a charge-transporting layer with film thickness of about 21 μm. The electro- graphic photoreceptor thus obtained is referred to as Sample 1.

EXAMPLE 2

In Example 1, the charge-generating substance (G-12) was used in place of (G-7), the amount of the exemplified compound was made as 0.2 g and the charge-transporting substance was changed to (d). Letting other conditions be alike, an electrographic photoreceptor of the present invention was obtained. This is referred to as Sample 2.

EXAMPLE 3

10 g of polyvinyl formal were dissolved in 1000 ml of isopropanol. The solution was coated by a roll coater on a PET base vapor-depositted with aluminium to form a subbing layer with film thickness of 0.18 μm.

Subsequently, 5 g of polycarbonate resin (Trade name; Panlite L-1250 made by Teijin Kasei Co.), 10 g of (G-12) as a charge-generating substance, and 1000 ml of 1,2-dichloroethane were put in a ball mill to grind and disperse to obtain a dispersion. To the dispersed liquid obtained was added 0.4 g of the exemplified compound (No. 5) and after stirring for about 1 hour, was coated by wire bar coating method on the above-described subbing layer to form a charge-generating layer with film thickness of about 0.18 μm.

Further, 150 g of polycarbonate resin (Trade name; Panlite K-1300 made by Teijin Kasei Co.) and 75 g of the charge-transporting substance (d) were dissolved in 1000 ml of 1,2-dichloroethane, and the solution was coated by roll coater coating method on the above-described charge-generating layer and dried at 110° C. for 20 minutes to form a charge-transporting layer with film thickness of about 21 μm. The thus obtained electrographic photoreceptor is referred to as Sample 3.

EXAMPLE 4

In Example 3, in place of the examplified compound (No. 5) was used (No. 17) and by making the amount of the exemplified compound as 0.8 g and letting the other conditions alike, obtained an electrographic photoreceptor of the present invention. This sample is referred to as Sample 4.

EXAMPLE 5

In Example 3, in place of the exemplified compound (No. 5) was used (No. 2) and the amount of the exemplified compound was made as 0.4 g and the other conditions be the same to obtain an electrographic photoreceptor of the present invention, which is referred to as Sample 5.

EXAMPLE 6

In Example 3, in place of the exemplified compound (No. 5) was used (No. 20) and by making the amount of the exemplified compound as 0.4 g and the other conditions alike, obtained an electrographic photoreceptor of the present invention which is referred to as Sample 6.

EXAMPLE 7

In Example 3, in place of the exemplified compound (No. 5), was used (No. 21) and by making the amount of the exemplified compound as 0.4 g and the other conditions alike, obtained an electrographic photoreceptor of the present invention, which is referred to as Sample 7.

EXAMPLE 8

In Example 3, in place of the exemplified compound (No. 5) was used (No. 30) and by making the amount of the exemplified compound as 1.2 g and the other conditions alike, obtained an electrographic photoreceptor of the present invention, which is referred to as Sample 8.

EXAMPLE 9

In Example 3, in place of the exemplified compound (No. 5), was used (No. 32) and by making the amount of the exemplified compound as 1.0 g and the other conditions alike, obtained an electrographic photoreceptor of the present invention, which is referred to as Sample 9.

EXAMPLE 10

In Example 3, in place of the exemplified compound (No. 5), was used (No. 48) and by making the amount of the exemplified compound a 0.4 g and the other conditions alike, obtained an electrographic photoreceptor of the present invention, which is referred to as Sample 10.

EXAMPLE 11

In Example 3, in place of the exemplified compound (No. 5), was used (No. 87) and by making the amount of the exemplified compound as 0.4 g and the other conditions alike, obtained an electrographic photoreceptor of the present invention, which is referred to as Sample 11.

EXAMPLE 12

10 g of polyvinyl formal resin was dissolved in 1000 ml of isopropanol, and the solution was coated on a PET base vapor-deposited with aluminium by a roll coater to form a subbing layer with film thickness of 0.18 μm.

Succeedingly, 5 g of polycarbonate resin (Trade name; Panlite L-1250 made by Teijin Kasei Co.), 10 g of (G-12) as a charge-generating substance, 0.4 g of the exemplified compound (No. 5) and 1000 ml of 1,2-dichloroethane were ground and dispersed in a ball mill to obtain a dispersed liquid. The dispersed liquid obtained was coated on the above-described subbing layer by wire-bar coating method to form a charge-generating layer with film thickness of about 0.18 μm. By effecting the other process as in the same manner as in Example 3, an electrographic photoreceptor of the present invention was obtained, which is referred to as Sample 12.

EXAMPLE 13

In Example 12, in place of the exemplified compound (No. 5) was used (No. 17), and the amount of the exemplified compound was made as 0.8 g and other conditions be alike to the ones in the other Examples. Thus, an electrographic photoreceptor of the present invention was obtained, which was named as Sample 13.

EXAMPLE 14

In Example 12, in place of the exemplified compound (No. 5), (No. 21) was used and the amount of the exemplified compound was made to be 0.8 g and other points to be the same as in previous cases, and an electrographic photoreceptor of the present invention was obtained, which is referred to as Sample 14.

COMPARATIVE EXAMPLE 1

In Example 3, except that the exemplified compound (No. 5) was not used, the other conditions were the same as in the other cases, and thus, an electrographic photoreceptor was obtained, which is referred to as Comparative Sample 1.

COMPARATIVE EXAMPLE 2

In Example 3, except that diethyl amine was used in place of the examplified compound (No. 5) in an equal amount, other processes were kept alike, and thus, an electrographic photoreceptor for comparative use was obtained, which is referred to as Comparative Sample 2.

COMPARATIVE EXAMPLE 3

In Example 3, except that 3 g of diethyldithiocarbamic telluride (a compound disclosed in Japanese Patent Publication Laid-Open No. 157/84) was used in place of the exemplified compound (No. 5), the process was effected in the same manner as in other cases, and an electrographic photoreceptor for comparative use was obtained, which is referred to as Comparative Sample 3.

COMPARATIVE EXAMPLE 4

0.2 g of the charge-generating substance (G-12) was dissolved into 50 g of denaturated ethanol.

Succeedingly 1.0 g of a cationic copolymer represented by the following constitutional formula and 0.05 g of 2,2'-azobis-2-aminopropan dihydrochloride were added to dissolve under room temperature. The solution was immediately coated on a support made by vapor-deposited 10 μm Al foil on a 80 μm bed by means of doctor blade coat system. The specimen was heated and dried at about 85° C. for two minutes.

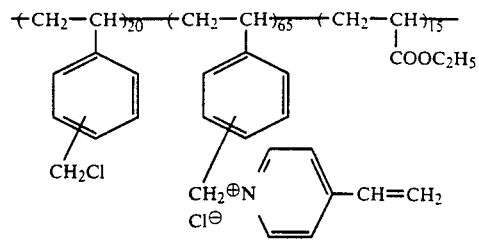

(In the above constitutional formula, the numbers represent the mol % of respective monomer units.)

In such a manner as this, a charge-generating layer with film thickness of about 0.3μ was obtained. (cf. Example 1 in Japanese Patent Publication Laid-Open No. 18631/83)

Next, the charge-transporting layer used in Example 3 was coated on this charge-generating layer and an electrographic photoreceptor was obtained, which is referred to as a Comparative Sample 4.

COMPARATIVE EXAMPLE 5

In Example 3, except that the exemplified compound (No. 5) was used in an amount of 2.5 g, other processes were the same, and an electrographic photoreceptor was obtained, which is referred to as a Comparative Sample 5.

Evaluation

Respective samples obtained as described above were evaluated in the manner as described in the following. A paper analyzer SP-428 (made by Kawaguchi Denki Co.) was used. It was electrically charged under the discharge condition of 40 μA for 5 seconds, and was exposed in such a manner that it gains the surface potential immediately after electrical charge [$V_a$], the surface potential after leaving in the dark for 5 seconds [$V_i$], and the surface luminous intensity 2 Lux. Exposure [$E_{\frac{1}{2}}$] (Lux. sec) until the surface potential becomes $\frac{1}{2}$ $V_i$ was obtained, and further, the dark attenuation rate [D] was obtained from the following formula.

$$D = \frac{V_a - V_i}{V_a} \times 100$$

The results are shown in Table-1.

Further, usual Carlson process was effected by using Samples 1 to 14 and Comparative Samples 1 and 2 to obtain the difference [$\Delta V_b$] of the surface potentials at the initial period and that immediately after 1000 times of electric charging and the residual potential after that of 1000 times. Also, for the surface potential $V_w$ after predetermined light amount illumination, the value after initial 1000 times was obtained. The results of these ones are shown in Table-2.

TABLE 1

| Sample No. | $V_a$ | $V_i$ | D | $E_{\frac{1}{2}}$ |
|---|---|---|---|---|
| Sample | | | | |
| 1 | 1390 | 1020 | 26.8 | 0.95 |
| 2 | 1380 | 1040 | 24.8 | 0.98 |
| 3 | 1500 | 1160 | 22.7 | 1.09 |
| 4 | 1460 | 1120 | 23.3 | 1.10 |
| 5 | 1420 | 1040 | 26.8 | 0.98 |
| 6 | 1470 | 1300 | 23.1 | 1.08 |
| 7 | 1420 | 1070 | 24.6 | 1.02 |
| 8 | 1440 | 1095 | 24.0 | 1.10 |
| 9 | 1450 | 1090 | 24.4 | 1.12 |

TABLE 1-continued

| Sample No. | $V_a$ | $V_i$ | D | $E_{\frac{1}{2}}$ |
|---|---|---|---|---|
| 10 | 1480 | 1125 | 24.0 | 0.99 |
| 11 | 1430 | 1035 | 27.6 | 1.04 |
| 12 | 1550 | 1160 | 25.2 | 1.03 |
| 13 | 1580 | 1210 | 23.4 | 1.07 |
| 14 | 1530 | 1190 | 22.3 | 1.06 |
| Comparative Sample | | | | |
| 1 | 1400 | 1040 | 25.7 | 0.98 |
| 2 | 1450 | 1090 | 24.8 | 1.05 |
| 3 | 1320 | 930 | 29.5 | 1.40 |
| 4 | 1250 | 900 | 28.0 | 4.9 |
| 5 | 1550 | 1170 | 24.5 | 1.07 |

TABLE 2

| Sample No. | $\Delta V_b$ | $V_r$ | $V_w$ (Initial) | $V_w$ (after 1000 times) |
|---|---|---|---|---|
| Sample | | | | |
| 1 | −95 | 10 | 70 | 55 |
| 2 | −100 | 7 | 70 | 48 |
| 3 | −62 | 10 | 84 | 73 |
| 4 | −67 | 6 | 45 | 40 |
| 5 | −64 | 9 | 83 | 78 |
| 6 | −51 | 8 | 80 | 75 |
| 7 | −74 | 3 | 20 | 20 |
| 8 | −57 | 16 | 80 | 65 |
| 9 | −58 | 14 | 85 | 70 |
| 10 | −63 | 8 | 52 | 35 |
| 11 | −90 | 4 | 32 | 28 |
| 12 | −65 | 7 | 60 | 55 |
| 13 | −85 | 15 | 40 | 45 |
| 14 | −61 | 20 | 68 | 50 |
| Comparative Sample | | | | |
| 1 | −240 | 20 | 50 | 30 |
| 2 | −95 | 40 | 75 | 100 |

Evaluation 2

The dispersion liquids obtained in Example 2 and Comparative Example 2 were coated per 24 hours for 4 days and obtained electrographic photoreceptors in the same manner. These were named as Samples 15, 16, 17, 18, and Comparative Samples 6, 7, 8, and 9. For these samples, [$V_a$], [$V_i$], [$E_{\frac{1}{2}}$] (Lux sec) and [D] were measured by above-described methods. The results are shown in Table-3.

Evaluation 3

For the Samples 4, 5, 6, and 7 and the Comparative Samples 3 and 5, after preserving them in a condition at temperature of 50° C. and relative humidity of 80% for one month, [$V_a$], [$V_i$], [$_{\frac{1}{2}}$] (Lux. sec) and [D] were measured by the afore-mentioned methods. The results are shown in Table-4.

TABLE 3

| Sample No. | $V_a$ | $V_i$ | D | $E_{\frac{1}{2}}$ |
|---|---|---|---|---|
| Sample | | | | |
| 15 | 1510 | 1165 | 22.8 | 1.08 |
| 16 | 1490 | 1150 | 22.8 | 1.07 |
| 17 | 1500 | 1160 | 22.7 | 1.09 |
| 18 | 1500 | 1160 | 22.7 | 1.09 |
| Comparative Sample | | | | |
| 6 | 1460 | 1080 | 26.0 | 1.07 |
| 7 | 1470 | 1080 | 26.5 | 1.21 |
| 8 | 1450 | 1055 | 27.2 | 1.35 |
| 9 | 1450 | 1040 | 28.3 | 1.48 |

TABLE 4

| Sample No. | $V_a$ | $V_i$ | D | $E_{\frac{1}{2}}$ |
|---|---|---|---|---|
| Sample | | | | |
| 4 | 1470 | 1120 | 23.8 | 0.98 |
| 5 | 1430 | 1050 | 26.6 | 0.95 |
| 6 | 1480 | 1140 | 23.0 | 0.98 |
| 7 | 1440 | 1090 | 24.3 | 0.97 |
| Comparative Sample | | | | |
| 3 | 1050 | 700 | 33.3 | 2.60 |
| 5 | 1500 | 960 | 36.0 | 2.48 |

As can be understood from these Tables, Comparative Sample 1 lacks the stability of the surface potential; in Comparative Sample 2, surface potential and residual potential are large; in Comparative Sample 3, sensitivity is not generated under high temperature and high humidity conditions, and dark attenuation is bad; Comparative Sample 4 generates no sensitivity; and Comparative Sample 5 has large dark attenuation and bad environment resistance.

On the contrary, the electrographic photoreceptor of the present invention scarcely shows lowering of sensitivity, has excellent repetition characteristics, and is stable in maintenance stability, so that it can be found to be stably used in production.

EXAMPLE 15

10 g of polyvinyl formal resin were dissolved in 1000 ml of isopropanol, and the solution was coated on a PET base vapor-deposited with aluminium by a roll coater to form a subbing layer with film thickness of 0.18 μm.

Subsequently, 5 g of polycarbonate resin (Trade name; Panlite L-1250 made by Teijin Kasei Co.), 10 g of (G12) as a charge-generating substance, and 1000 ml of 1,2-dichloroethane were ground and dispersed in a ball mill to obtain a dispersed liquid. The dispersed liquid obtained was added with 1.6 g of the exemplified compound (No. 5), and after stirring for 1 hour, was coated on the above-described subbing layer by wire bar method to form a charge-generating layer with film thickness of about 0.18 μm.

Furthermore, 150 g of polycarbonate resin (Trade name; Panlite K-1300 made by Teijin Kasei Co.), and 75 g of the charge-transporting substance (d) dissolved in 1000 ml of 1,2-dichloroethane, and the solution was coated on said charge-generating layer by roll coater method to form a charge-transporting layer with thickness of about 21 μm, after drying at 110° C. for 20 minutes. The electrographic photoreceptor for laser exposure use thus obtained is referred to as Sample 15.

Example 16

In Example 15, in place of the exemplified compound (No. 5), was used (No. 17), and by making the amount of exemplified compound as 0.8 g and others be the same as above, obtained an electrographic photoreceptor for laser exposure use, which is referred to as Sample 16.

EXAMPLE 17

In Example 15, in place of exemplified compound (No. 5) was used (No. 2), and by making the amount of exemplified compound as 0.4 g and others be the same, obtained an electrographic photoreceptor for laser exposure use of the present invention. This is referred to as Sample 17.

EXAMPLE 18

Example 15 in place of exemplified compound (No. 5) was used (No. 20), and by making the amount of exemplified compound as 0.4 g and others be the same, obtained an electrographic photoreceptor for laser exposure use of the present invention. This is referred to as Sample 18.

EXAMPLE 19

In Example 15, in place of exemplified compound (No. 5) was used (No. 21), and by making the amount of exemplified compound as 0.4 g and others be the same, obtained an electrographic photoreceptor for laser exposure use of the present invention. This is referred to as Sample 19.

EXAMPLE 20

In Example 15, in place of exemplified compound (No. 5) was used (No. 30), and by making the amount of exemplified compound as 1.2 g and others be the same, obtained an electrographic photoreceptor for laser exposure use of the present invention. This is referred to as Sample 20.

EXAMPLE 21

In Example 15, in place of exemplified compound (No. 5), (No. 32) was used, and by making the amount of exemplified compound as 2.0 g and the others be the same, obtained an electrographic photoreceptor for laser exposure use of the present invention. This is referred to as Sample 21.

EXAMPLE 22

In Example 15, in place of exemplified compound (No. 5) was used (No. 46), and by making the amount of exemplified compound as 0.4 g and the others be the same, an electrographic photoreceptor for laser exposure use of the present invention was obtained. This is referred to as Sample 22.

EXAMPLE 23

In Example 15, in place of exemplified compound (No. 5) was used (No. 67), and by making the amount of exemplified compound as 0.4 g and the others be the same, an electrographic photoreceptor for laser exposure use of present invention was obtained. This is referred to as Sample 23.

EXAMPLE 24

10 g of polyvinyl formal resin were dissolved in 1000 ml of isopropanol, and the solution was coated on a PET base vapor-deposited with aluminium by a roll coater to form a subbing layer with film thickness of 0.18 μm. Next, 5 g of polycarbonate resin (Trade name; Panlite L-1250 made by Teijin Kasei Co.), 10 g of (G-12) as a charge-generating substance, 0.4 g of exemplified compound (No. 5) and 1000 ml of 1,2-dichloroethane were put in a ball mill to grind and disperse to obtain a dispersed liquid. The dispersed liquid obtained was coated on said subbing layer by the wire bar coating method to form a charge-generating layer with film thickness of about 0.18 μm. By making others be the same as in Example 1, an electrographic photoreceptor for laser exposure use was obtained. This is referred to as Sample 24.

EXAMPLE 25

In Example 24, in place of exemplified compound (No. 5) was used (No. 17), and making the amount of exemplified compound as 0.8 g and the other processes be the same, an electrographic photoreceptor for laser exposure use was obtained. This is referred to as Sample 25.

EXAMPLE 26

In Example 24, without providing a subbing layer, and by using (No. 21) in place of the exemplified compound (No. 5) and making the amount of the exemplified compound be 0.8 g and other processes be the same, an electrographic photoreceptor for laser exposure use of the present invention was obtained. This is referred to as Sample 26.

COMPARATIVE EXAMPLE 6

In Example 15, except that the exemplified compound (No. 5) is not used, the other processes were made be the same, and a comparative electrographic photoreceptor for laser exposure use was obtained. This is referred to as Comparative Sample 6.

COMPARATIVE EXAMPLE 7

In Example 15, except that the same amount of diethyl amine was used in place of the exemplified compound (No. 5), the other processes were made be the same, and a comparative electrographic photoreceptor for laser exposure use was obtained. This is referred to as Comparative Sample 7.

COMPARATIVE EXAMPLE 8

In Example 15, except that 3 g of tellurium diethyldichiocarbamate (a compound disclosed in Japanese Patent Publication No. 157/83) was used, other processes were made be alike, and a comparative electrographic photoreceptor for laser exposure use was obtained. This is referred to as Comparative Sample 8.

COMPARATIVE EXAMPLE 9

0.2 g of the charge-generating substance (G-12) was dissolved in 50 g of denaturated ethanol.

Succeedingly, 1.0 g of cation copolymer shown by the following constitutional formula and 0.05 g of 2,2'-azo-bis-2-aminopropane dihydrochloride was added to be dissolved under room temperature, and the solution was coated immediately on a support made by vapor deposition of 10 μm Al foil on an 80 μm bed by a doctor-blade coating system to be heat-dried at about 85° C. for two minutes.

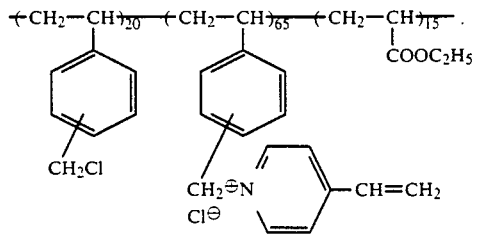

(Numerals in the above-described constitutional formula represent mol % of respective monomer units)

In such a manner as described above, a charge-generating layer with thickness of about 0.3μ was obtained. (cf. Example 1 in Japanese Patent Publication Laid-Open No. 18831/83)

Next, the charge-transporting layer used in Example 1 was coated on this charge-generating layer to obtain an electrographic photoreceptor for laser exposure use. This is referred to as Comparative Sample 9.

Evaluation

Respective samples obtained as described above were evaluated as follows:

A paper analyzer SP-428 (made by Kawaguchi Co.) was used to charge the sample under a discharge condition of 40 μA for 5 seconds, and the sample was exposured to get surface potential immediately after charge [$V_a$]; surface potential after being left in the dark for 5 min. [$V_i$]; and surface illumination intensity of 2 Lux. Then, the amount of exposure until surface potential becomes ½ $V_i$ i.e. [$E_{\frac{1}{2}}$] (Lux. sec) was obtained, and further, an electrographic photoreceptor for laser exposure use was obtained. This is referred to as Comparative Sample 8.

From the following formula, dark attenuation ratio [D] was obtained. The results are shown in Table-5

$$D = \frac{V_a - V_i}{V_a} \times 100$$

Further, by using Samples 1 to 12 and Comparative Samples 1 and 8, together with effecting usual Carlson process, the difference of the surface potential at initial period and immediately after the charging after 10000 times [$\Delta V_b$] and residual potential after 10000 times [$V_r'$] were obtained. The results are shown in Table-6.

TABLE 5

| Sample No. | $V_a$ | $V_i$ | D | $E_{\frac{1}{2}}$ |
|---|---|---|---|---|
| Sample | | | | |
| 15 | 1520 | 1170 | 23.2 | 1.12 |
| 16 | 1460 | 1120 | 23.3 | 1.10 |
| 17 | 1420 | 1040 | 26.8 | 0.98 |
| 18 | 1470 | 1300 | 23.1 | 1.08 |
| 19 | 1420 | 1070 | 24.6 | 1.02 |
| 20 | 1440 | 1095 | 24.0 | 1.10 |
| 21 | 1455 | 1100 | 24.4 | 1.14 |
| 22 | 1480 | 1125 | 24.0 | 0.99 |
| 23 | 1430 | 1035 | 27.6 | 1.04 |
| 24 | 1550 | 1160 | 25.2 | 1.03 |
| 25 | 1580 | 1210 | 23.4 | 1.07 |
| 26 | 1510 | 1140 | 24.5 | 1.17 |
| Comparative Sample | | | | |
| 6 | 1400 | 1040 | 25.7 | 0.98 |
| 7 | 1450 | 1090 | 24.8 | 1.05 |
| 8 | 1320 | 930 | 29.5 | 1.40 |
| 9 | 1250 | 900 | 28.0 | 4.9 |

TABLE 6

| Sample No. | $\Delta V_b$ | $V_r'$ | $V_w$ (Initial) | $V_w$ (after 10000 times) |
|---|---|---|---|---|
| Sample | | | | |
| 15 | −55 | 10 | 85 | 75 |
| 16 | −67 | 6 | 45 | 40 |
| 17 | −64 | 9 | 83 | 78 |
| 18 | −51 | 8 | 80 | 75 |
| 19 | −74 | 3 | 20 | 20 |
| 20 | −57 | 16 | 80 | 65 |
| 21 | −62 | 16 | 85 | 65 |
| 22 | −63 | 8 | 52 | 35 |
| 23 | −90 | 4 | 32 | 28 |
| 24 | −65 | 7 | 60 | 55 |
| 25 | −85 | 15 | 40 | 45 |
| 26 | −80 | 22 | 70 | 48 |

TABLE 6-continued

| Sample No. | $\Delta V_b$ | $V_r'$ | $V_w$ (Initial) | $V_w$ (after 10000 times) |
|---|---|---|---|---|
| Comparative Sample | | | | |
| 6 | −240 | 20 | 50 | 30 |
| 7 | −95 | 40 | 75 | 100 |

COMPARATIVE EXAMPLE 10

The dispersed liquid obtained by using No. 2 in place of the exemplified compound No. 5 and the dispersed liquid obtained by Comparative Example 7 were coated per 24 hours for 4 days, and by effecting in the same manner as in previous examples, electrographic photoreceptors for laser exposure use were obtained. These are referred to as Samples 27, 28, 29 and 30, and as Comparative Samples 10, 11, 12 and 13. For these samples, [$V_a$], [$V_i$], [$E_{\frac{1}{2}}$] (Lux. sec) and [D] were measured. Results are shown in Table-7.

COMPARATIVE EXAMPLE 11

Samples 16, 17, 18, and 19, and Comparative Sample 8 were preserved under environment of a temperature of 50° C. and relative humidity of 80% for one month. Subsequently, [$V_a$], [$V_i$], [$E_{\frac{1}{2}}$] (Lux. sec) and [D] were measured The results are shown in Table-8.

TABLE 7

| Sample No. | $V_a$ | $V_i$ | D | $E_{\frac{1}{2}}$ |
|---|---|---|---|---|
| Sample | | | | |
| 27 | 1460 | 1085 | 25.8 | 1.01 |
| 28 | 1470 | 1098 | 25.4 | 1.02 |
| 29 | 1460 | 1085 | 25.8 | 1.01 |
| 30 | 1480 | 1100 | 25.6 | 1.01 |
| Comparative Sample | | | | |
| 10 | 1460 | 1080 | 26.0 | 1.07 |
| 11 | 1470 | 1080 | 26.5 | 1.21 |
| 12 | 1450 | 1055 | 27.2 | 1.35 |
| 13 | 1450 | 1040 | 28.3 | 1.48 |

TABLE 8

| Sample No. | $V_a$ | $V_i$ | D | $E_{\frac{1}{2}}$ |
|---|---|---|---|---|
| Sample | | | | |
| 16 | 1470 | 1120 | 23.8 | 0.98 |
| 17 | 1430 | 1050 | 26.6 | 0.95 |
| 18 | 1480 | 1140 | 23.0 | 0.98 |
| 19 | 1440 | 1090 | 24.3 | 0.97 |
| Comparative Sample | | | | |
| 8 | 1050 | 700 | 33.3 | 2.60 |

As can be understood from these Tables, Comparative Sample 6 lacks the stability of surface potential, Comparative Sample 7 has large surface potential and large residual potential, Comparative Sample 8 can not exhibit sensitivity under conditions of high temperature and high humidity, and has large dark attenuation, that is, environmental resistance is bad, Comparative Sample 9 is showed reduced sensitivity and has bad environment resistance, and Comparative Samples 10 to 13 are known to lack production stability.

On the contrary, the electrographic photoreceptor of the present invention has scarcely no lowering of sensitivity, has excellent repetitive characteristics and is also stable in the preservation stability, so that it will be evidently known that it can be also stably used in manufacturing.

EXAMPLE 27

Printing was effected with a trial laser printer mounted with a semiconductor laser (3 mW, 790 nm) by using Samples 15 to 26, but, in any case, good picture images having no moire could be obtained. Although the printing was continued for 3000 pieces of sheets, even in the 3000th one, a good picture image could be obtained which has no moire as alike to the initial one.

COMPARATIVE EXAMPLE 12

Comparative Samples 6 to 9 were subjected to printing by using the same trial printer as the one used in Example 27, but there were generated moire picture images from the initial period to begin with.

We claim:

1. A photoreceptor for electrophotography comprising a layer containing a charge-generating substance on an electroconductive substrate, wherein said photoreceptor contains an ammonium compound represented by Formula (I) in an amount of 0.1 to 15 parts by weight per 100 parts by weight of said charge-generating substance, Formula (I)

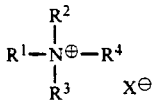

wherein $R^1$ is a cyclic or non-cyclic hydrocarbon group which may be substituted; $R^2$, $R^3$, and $R^4$ are independently a hydrogen atom, a cyclic hydrocarbon group, and a non-cyclic hydrocarbon group, provided that at least one of $R^2$, $R^3$, and $R^4$ is a hydrogen atom; and X is an anion.

2. A photo-receptor of claim 1, wherein said quadrivalent nitrogen-containing cyclic compound is a compound of the general formula (II) or (III);

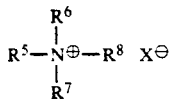

(II)

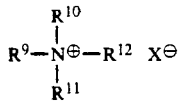

(III)

(wherein, $R^5$, $R^6$ and $R^9$ are independently selected from the group consisting of a hydrogen atom and a non-cyclic hydrocarbon group which may be substituted and a cyclic hydrocarbon group which may be substituted; $R^7$ and $R^8$ are independently groups necessary to complete a substituted or unsubstituted nitrogen-containing heterocyclic group including the quadrivalent nitrogen by being cooperatively connected with each other; $R^{10}$, $R^{11}$ and $R^{12}$ are independently groups necessary to complete a substituted or unsubstituted nitrogen-containing heterocyclic group including the quadrivalent nitrogen by being cooperatively connected with each other; and $X^{\ominus}$ is an anion).

3. The photo-receptor of claim 1, wherein said ammonium salt has a molecular weight not than 2000.

4. The photo-recepetor of claim 1, wherein said ammonium salt has a molecular weight of not more than 1000.

5. The photo-receptor of claim 1, wherein said ammonium salt has a molecular weight of not more than 750.

6. The photo-receptor of claim 1, wherein the low molecular weight ammonium salt is contained in said layer.

7. The photo-receptor of claim 6, wherein said non-cyclic hydrocarbon group is selected from the group consisting of a saturated or unsaturated non-cyclic hydrocarbon group, and wherein said cyclic hydrocabon group is selected from the group consisting of a mono cyclic hydrocarbon group, a bridged hydrocarbon ring and a condensed hydrocarbon ring.

8. The photo-receptor of claim 6, wherein said saturated or unsaturated non-cyclic hydrocarbon group is selected from the group consisting of an alkyl group having 1 to 20 carbon atoms, an alkenyl group having 1 to 20 carbon atoms, an alkynyl group and an alkadienyl group, and wherein said cyclic hydrocabon group is selected from the group consisting of a mono cyclic hydrocarbon group having 3 to 12 carbon atoms, a bridged hydrocarbon ring having 6 to 18 carbon atoms and a condensed hydrocarbon ring having 7 t 18 carbon atoms.

9. The photo-receptor of claim wherein said low molecular weight ammonium salt is a compound represented by the formulas (A]to (K) below;

(A)

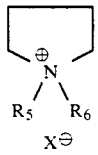

(B)

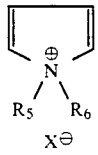

(C)

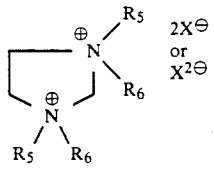

(D)

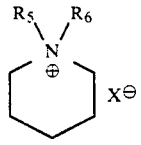

(E)

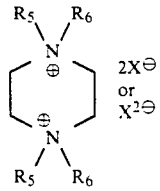

-continued (F)

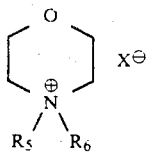

(G)

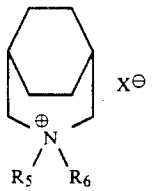

(H)

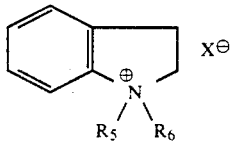

(I)

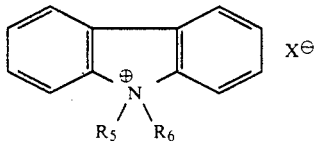

(J)

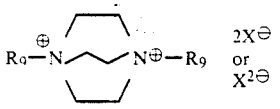

(K)

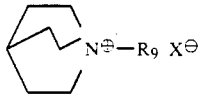

wherein $R_5$, $R_6$ and $R_9$ respectively represent the same atom . or group as defined in the formulas (II) and (III); $X^{\ominus}$ represents a monovalent anion and $X^{2\ominus}$ represents a divalent anion.

10. The photo-receptor of claim 2, wherein said low molecular weight ammonium salt is a compound represented by the formula $$N\oplus(H)_l\cdot(CnHzn+1)m\ X^{\ominus}$$

wherein 1 is an integer of 0 to 3, m is an integer of 1 to 4 provided that 1+m is 4, n is an integer of 1 to 20, and X is an anion

11. The photo-receptor of claim 10, wherein 1 is 2, m is 2, n is an integer of 1 to 8, and X is a halogen atom.

12. The photo-receptor of claim 6, wherein said layer contains a binder in a quantity of less than 500 parts by weight with respect to 100 parts by weight of said charge generating substance.

13. The photo-receptor of claim 6, wherein said layer contains a binder in a quantity of less than 200 parts by weight with respect to 100 parts by weight of said charge generating substance.

14. The photo-receptor of claim 6, wherein the thickness of the layer is in the range of 0.01 to 10 μm.

15. The photo-receptor of claim 6, wherein the thickness of said layer is in the range of 0.05 to 5μm.

16. The photo-receptor of claim 1, wherein said charge generating substance is selected from the group consisting of guaiazulene pigments, perylene pigments, phthaocyanine pigments, pyrylium pigments, quinacridone pigments, indigo pigments cyanine pigments and azo pigments.

17. The photo-receptor of claim 16, wherein said charge generating substance is selected from the group consisting ol bis-azo pigments, tris-azo pigments and phthalocyanine pigments.

18. The photo-receptor of claim 6, wherein said photoreceptor comprises a subbing layer between said conductive substrate and said layer.

19. A photo-receptor for electrography comprising an electrically conductive substrate, a first layer provided on said substrate and containing an organic charge generating substance and a low molecular weight ammonium salt at a proportion of 0.1 to 15 parts by weight with respect to 100 parts by weight of said charge generating substance and a second layer provided on said first layer and containing a charge transporting substance.

20. The photo-receptor of claim 19, wherein said first layer contains a charge transporting substance.

21. The photo-receptor of claim 19, wherein said photoreceptor comprises a subbing layer between said substrate and said second layer.

22. The photo-receptor of claim 20, wherein said photoreceptor comprises a subbing layer between said substrate and said second layer.

23. A method for producing an electrostatic latent image on a photoreceptor comprising, a step of uniformly and electrically charging the surface of a photo-receptor which comprises an electrically conductive substrate and a layer provided on said substrate and containing an organic charge generating substance and a low molecular weight ammonium salt at a proportion of 0.1 to 15 parts by weight with respect to 100 parts by weight of said charge generating substance, and a step of imagewise exposing said photo-receptor to a laser light.

24. The method of claim 23, wherein said imagewise exposure is carried out by the use of light emitted from a semiconductor laser.

* * * * *